US010329502B2

(12) United States Patent
Martin et al.

(10) Patent No.: US 10,329,502 B2
(45) Date of Patent: Jun. 25, 2019

(54) PROTECTION OF LIQUID FUELS

(71) Applicant: Palox Limited, Limassol (CY)

(72) Inventors: David William Martin, Liverpool (GB); Dietmar Posselt, Heidelberg (DE); Gunter Oetter, Frankenthal (DE); Matthias Kiefer, Ludwigshafen (DE)

(73) Assignee: PALOX LIMITED, Limassol (CY)

( * ) Notice: Subject to any disclaimer, the term of this patent is extended or adjusted under 35 U.S.C. 154(b) by 0 days.

(21) Appl. No.: 16/058,551

(22) Filed: Aug. 8, 2018

(65) Prior Publication Data

US 2018/0346832 A1 Dec. 6, 2018

Related U.S. Application Data

(62) Division of application No. 13/522,008, filed as application No. PCT/GB2011/050206 on Feb. 7, 2011, now abandoned.

(30) Foreign Application Priority Data

Feb. 5, 2010 (GB) ..... 1001923.0

(51) Int. Cl.

| | |
|---|---|
| ***C10L 1/32*** | (2006.01) |
| ***C10L 1/18*** | (2006.01) |
| ***C10L 1/14*** | (2006.01) |
| *C10L 1/182* | (2006.01) |
| *C10L 1/198* | (2006.01) |
| *C10L 1/222* | (2006.01) |

(52) U.S. Cl.

CPC ..... *C10L 1/143* (2013.01); *C10L 1/328* (2013.01); *C10L 1/1824* (2013.01); *C10L 1/1826* (2013.01); *C10L 1/1985* (2013.01); *C10L 1/2222* (2013.01); *C10L 2200/0254* (2013.01); *C10L 2200/043* (2013.01); *C10L 2250/084* (2013.01); *C10L 2270/04* (2013.01)

(58) Field of Classification Search

CPC combination set(s) only.
See application file for complete search history.

(56) References Cited

U.S. PATENT DOCUMENTS

| | | | |
|---|---|---|---|
| 2,886,423 | A | 5/1959 | Vitalis et al. |
| 3,032,971 | A | 5/1962 | Shotton et al. |
| 5,490,948 | A | 2/1996 | Klier et al. |
| 2007/0202069 | A1 | 8/2007 | Tamareselvy et al. |
| 2012/0267481 | A1 | 10/2012 | Martin |

FOREIGN PATENT DOCUMENTS

| | | |
|---|---|---|
| WO | WO 1997/039087 | 10/1997 |
| WO | WO 1999/052994 | 10/1999 |
| WO | WO 2005/093028 A1 | 10/2005 |
| WO | WO 2007/083106 A2 | 7/2007 |

OTHER PUBLICATIONS

"Kerosene." Gale Encyclopedia of U.S. Economic History. Encyclopedia.com. Sep. 2, 2018 <http://www.encyclopedia.com> (Year: 2018).*

International Preliminary Report on Patentability—PCT/GB2011/050206, dated Aug. 7, 2012.

International Search Report and Written Opinion of ISA—PCT/GB2011/050206, dated May 6, 2011.

* cited by examiner

*Primary Examiner* — Ellen M McAvoy
*Assistant Examiner* — Chantel L Graham
(74) *Attorney, Agent, or Firm* — Birch, Stewart, Kolasch & Birch, LLP

(57) ABSTRACT

A liquid concentrate comprising essentially:

(A) 0.1 to 10 wt. % of one or more amphoteric emulsifying agents;

(B) 30 to 95 wt. % of one or more nonionic alkoxylated surfactants;

(C) 0 to 20 wt. % of one or more glycol-based solubilizers; and (D) 0 to 65 wt. % of one or more organic solvents;

wherein component (B) comprises a mixture of $C_6$-$C_{15}$-alkanol ethoxylates with different carbon numbers for the alkanol unit species, the carbon numbers for the two $C_6$-$C_{15}$-alkanol ethoxylates which have the highest share in weight in the mixture being at least 1.5 carbon numbers distant from each other, is useful for reducing or eliminating the formation in a liquid hydrocarbon fuel of ice particles having a weight average particle size greater than 1 μm when said liquid hydrocarbon fuel is cooled to temperatures in the range of from 0 to −50° C.

10 Claims, No Drawings

PROTECTION OF LIQUID FUELS

CROSS REFERENCE TO RELATED APPLICATIONS

This application is a Divisional of copending application Ser. No. 13/522,008, filed on Jul. 12, 2012, which was filed as PCT International Application No. PCT/GB2011/050206 on Feb. 7, 2011, which claims the benefit under 35 U.S.C. § 119(a) to Patent Application No. 1001923.0, filed in the United Kingdom on Feb. 5, 2010, all of which are hereby expressly incorporated by reference into the present application.

FIELD OF THE INVENTION

The present invention concerns the protection of liquid fuels, such as liquid fuels typically used in engines employed to provide motive power in vehicles such as, although not limited, turbine engined aircraft. In particular, the present invention is concerned with the protection of such liquid fuels from the deleterious effects of contamination by water, such as the effect on engines caused by the presence of water as a separate phase in a fuel. The present invention more importantly provides protection to liquid fuels from ice formation, thereby reducing the potential for ice slugs to be drawn in to the engine.

The present invention also concerns compositions, a method for their preparation and use and concentrates. More particularly, though not exclusively, the present invention concerns water-in-oil microemulsions, such as are suitable for use as a fuel for a turbine engine aircraft, and its preparation.

In summary, the present invention concerns clear aqueous compositions which comprise at least 99 wt % of a liquid fuel and concentrates useful in the preparation of such compositions, which compositions are useful as a fuel for turbine engine aircraft, such as water-in-oil emulsions wherein the average droplet size of the water phase in the oil phase is no greater than 0.25 m, preferably no greater than 0.1 m, and their preparation.

BACKGROUND OF THE INVENTION

Jet fuel often becomes contaminated in a fuel tank of a turbine engine aircraft with small quantities of free water from condensation arising from the changes in temperature due to altitude changes. On the ground the fuel/tank temperature can range from −18° C. to +40° C., whilst in flight it typically ranges from −22° C. to −39° C.

Over a number of temperature change cycles, for example over a number flights, condensation of the water vapour can give rise to the accumulation of water within the fuel tank which may exist as a separate phase or free water within the fuel. If the free water is permitted to pool and freeze in the fuel tank, it can form slugs of ice (ice particles of sufficient size such that they may be trapped in the fuel filtering system) which can be potentially harmful to the function of the aircraft engines. Indeed, it is believed a Boeing 777 aircraft lost sufficient power to cause an emergency landing at Heathrow in January 2008 due to the formation of ice reducing the flow of fuel from the fuel tanks to the engines (AAIB interim report No 2 G-YMMM).

At present, as an alternative to employing fuel tank heaters, materials such as diethylene glycol monomethyl ether (DiEGME) are mixed with aircraft fuel to prevent ice formation in the fuel. Whilst DiEGME is about equally miscible in both water and fuel at temperatures above freezing, careful monitoring during the mixing process must be adhered to at all times to ensure an initial homogenous fuel. However, no matter how carefully mixed, DiEGME has a tendency at temperatures significantly below freezing to preferentially concentrate in the water phase. Thus, due to disproportionate distribution of DiEGME in the water and fuel at low temperatures, insufficient DiEGME in the fuel phase can lead to the formation of a separate aqueous phase (water and DiEGME) in the fuel. The presence of the DiEGME in the aqueous phase will prevent some of the water in this phase from turning to ice. However, the DiEGME/water mixture has an unusual characteristic in that it forms a gel like substance at low temperatures: the gel like substance is commonly referred to as "apple jelly" in the aviation industry. The US Federal Aviation Authority has attributed several aviation accidents to the formation of this "apple jelly" material in aircraft fuel tanks.

It is an object of the present invention to reduce or eliminate the formation of ice slugs and apple jelly in fuel in the fuel tanks of turbine engine aircraft.

The use of water as an additive in fuel oils to reduce emissions of pollutants and to aid incorporation of other beneficial performance additives has been known for many years. The use of water as an additive in lubricant oils to improve the cooling properties of e.g. cutting oils has also been known for many years. Water is incorporated into the fuel and lubricant oils in the form of a water-in-oil emulsion.

Water-in-oil emulsions formed with a large water droplet size tend to have a milky appearance. These emulsions require a number of secondary additives such as corrosion inhibitors and bactericides to overcome problems associated with addition of the water phase. These macroemulsions, due to their large water droplet size, also tend to exhibit instability that leads to oil/water separation. Naturally, this is unwelcome as it may lead to problems with not only machine failure but also problems with ignition e.g. in a diesel-engine.

Cutting oils, based on water-in-oil emulsions, have been used to lubricate machine tools. The excellent coolant property of the water has been demonstrated to improve the life of the tool. However, the incorporation of water coupled with the instability of macroemulsions give rise to other problems, such as the lubricity of the oil, which is decreased with addition of water thereby affecting the surface finish of the metal.

Water-in-oil emulsions formed with an average water droplet size of 0.25 μm or less, preferably of 0.1 μm or less, more preferably of from 0.03 μm to 0.08 μm (hereafter referred to as "microemulsions") are translucent. A typical value for the average water droplet size is about 0.04 μm. This small droplet size not only gives an appearance which is more aesthetically pleasing to the user but also offers several major advantages over the larger droplet-sized systems. These translucent or clear microemulsions tend to be more stable than the larger droplet sized milky macroemulsions, as the water droplets remain in dispersion longer and do not readily undergo macro oil/water phase separation. The small droplet size also appears to negate the need for both corrosion inhibitors and bactericides.

U.S. Pat. No. 3,095,286 (Andress et al) discloses the problem of water accumulation in fuel oil storage tanks, resulting from the "breathing" of storage vessels, presenting a problem of rusting. To inhibit sedimentation, screen clogging and rusting in fuel oil compositions during storage it is disclosed to use a compound selected from a phthalamic acid, a tetrahydrophthalamic acid, a hexahydrophthalamic acid and a nadamic acid and their salts of primary amines having between 4 and 30 carbon atoms per molecule as an addition agent to the fuel oil. There is no disclosure of the addition agents forming water-in-oil microemulsions of the fuel oil.

U.S. Pat. No. 3,346,494 (Robbins et al) discloses the preparation of microemulsions employing a selected combination of three microemulsifiers, specifically a fatty acid, an amino alcohol and an alkyl phenol.

FR-A-2373328 (Grangette et al) discloses the preparation of microemulsions of oil and salt water by employing sulphur containing surfactants.

U.S. Pat. No. 3,876,391 (McCoy et al) discloses a process for preparing clear, stable water-in-petroleum microemulsions, which may contain increased quantities of water-soluble additives. The microemulsions are formed by use of both a gasoline-soluble surfactant and a water-soluble surfactant. The only water-soluble surfactants employed in the worked examples are ethoxylated nonylphenols.

U.S. Pat. No. 4,619,967 (Emerson et al) discloses the use of water-in-oil emulsions for emulsion polymerisation processes.

U.S. Pat. No. 4,744,796 (Hazbun et al) discloses stable water-in-fuel microemulsions employing a cosurfactant combination of tertiary butyl alcohol and at least one amphoteric, anionic, cationic or nonionic surfactant. Cocoamidobetaines are disclosed as possible amphoteric surfactants.

U.S. Pat. No. 4,770,670 (Hazbun et al) discloses stable water-in-fuel microemulsions employing a cosurfactant combination of a phenyl alcohol and at least one amphoteric, anionic, cationic or nonionic surfactant. Cocoamidobetaines are disclosed as possible amphoteric surfactants.

U.S. Pat. No. 4,832,868 (Schmid et al) discloses surfactant mixtures useful in the preparation of oil-in-water emulsions. There is no disclosure of any water-in-oil microemulsion comprising at least 60 wt % oil phase.

U.S. Pat. No. 5,633,220 (Cawiezel) discloses the preparation of a water-in-oil emulsion fracturing fluid including an emulsifying agent sold by ICI under the trademark Hypermer (Hypermer emulsifying agents are not disclosed as being $C_6$-$C_{15}$ alcohol ethoxylates or mixtures thereof).

Mixtures of $C_6$-$C_{15}$ alcohol ethoxylates are commercially available surfactants normally sold for use in the preparation of e.g. washing detergents.

WO-A-9818884 discloses water-in-fuel microemulsions, including examples of such emulsions comprising a $C_8$ alcohol ethoxylate, with 6 EO groups, mixed with a polyglyceryl-4-monooleate, and mixtures of $C_9$-$C_{11}$ alcohol ethoxylates mixed with either polyglyceryl oleates linear alcohols or POE sorbitan alcohols. The presence of the polyglyceryl oleates and POE sorbitan alcohols tend to have detrimental effects on the viscosity properties of the emulsions which, in turn, has a consequential detrimental effect on the lubricity properties of the emulsion.

WO-A-9850139 discloses a water-in-oil microemulsion, including a surfactant mixture comprising a fatty acid amine ethoxylate, a $C_6$-$C_{15}$ alcohol ethoxylate and optionally a tall oil fatty acid amine. The water-in-oil microemulsion may be an industrial lubricant.

WO-A-0053699 discloses a water-in-oil microemulsion, including emulsifying agents comprising a $C_6$-$C_{15}$ alcohol ethoxylate, an amine ethoxylate and a polyisobutylsuccininide or sorbitan ester. The water-in-oil microemulsion may be a fuel.

EP-A-1101815 discloses a fuel, particularly for diesel engines, in microemulsion form, comprising a liquid fuel, an emulsifier and an emulsive agent, the emulsive agent having an HLB value higher than 9.

U.S. Pat. No. 6,716,801 discloses a stable, clear water-in-oil microemulsion consisting of from about 5 to 40 wt % aqueous phase and from about 95 to about 60 wt % non-aqueous phase. The microemulsion includes from about 5 to 30 wt % emulsifiers consisting of i) a mixture of $C_6$-$C_{15}$ alcohol ethoxylates each comprising from 2 to 12 EO groups, 0 to about 25 wt % polyisobutylsuccinimide and/or sorbitan ester, and iii) 0 to about 90 wt % amine ethoxylate. The microemulsion is described to be useful as a fuel and/or lubricant/coolant.

Mixtures of liquid emulsifying agents suitable for use in the preparation of water-in-oil microemulsions are disclosed in WO-A-07083106. Such mixtures, commonly referred to as concentrates, comprise about 0.5 to about 15 wt % fatty ($C_8$-$C_{24}$)-amido-($C_1$-$C_6$)alkyl betaine, about 5 to about 99 wt % $C_6$-$C_{15}$ alcohol ethoxylate comprising from 2 to 12 EO groups or a mixture of such alcohol ethoxylates, preferably the mixture, 0.5 to about 15 wt % ($C_6$-$C_{24}$)alkyl amine oxide and 0 or upto about 94 wt % other non-ionic emulsifying agent based on the total weight of emulsifying agent in the emulsion.

None of the above prior art references, however, discloses the performance of water-in-oil emulsions at low temperatures.

SUMMARY OF THE INVENTION

The present invention, in its various aspects, is as set out in the accompanying claims.

In a first aspect the present invention provides a liquid concentrate comprising essentially:

(A) 0.1 to 10 wt. % of one or more amphoteric emulsifying agents;

(B) 30 to 95 wt. % of one or more nonionic alkoxylated surfactants;

(C) 0 to 20 wt. % of one or more glycol-based solubilizers; and (D) 0 to 65 wt. % of one or more organic solvents, wherein component (B) comprises a mixture of $C_6$-$C_{15}$-alkanol ethoxylates with different carbon numbers for the alkanol unit species, the carbon numbers for the two $C_6$-$C_{15}$-alkanol ethoxylates which have the highest share in weight in the mixture being at least 1.5 carbon numbers, preferably at least 2.0 carbon numbers, more preferably at least 2.5 carbon numbers, most preferably at least 3.0 carbon numbers, distant from each other. Preferably, in the mixture of $C_6$-$C_{15}$-alkanol ethoxylates, the carbon number for one of the two $C_6$-$C_{15}$-alkanol ethoxylates which have the highest share in weight in the mixture are in the range of 9 to 11 for one and in the range of 12 to 14 for the other. Each of the species of the $C_6$-$C_{15}$-alkanol ethoxylates mixture can be independently from each other an ethoxylate of a pure single-carbon alkanol or an ethoxylate of a mixture of alkanol homologues with a statistical carbon number distribution.

In a second aspect, the present invention provides a process for manufacturing a concentrate of the first aspect, characterised in that components (A) to (D) are mixed together at a temperature in the range of from −10° C. to 60° C., preferably 0° C. to 40° C.

In a third aspect, the present invention provides a stable water-in-oil-emulsion, preferably a water-in-oil microemulsion comprising (a) a liquid fuel or oil which is immiscible with water;
(b) up to 1 wt. %, preferably up to 0.1 wt. %, based on the amount of (a), of water; and
(c) 10 to 10,000 wt·ppm, preferably 10 to 1,000 wt·ppm, based on the amount of (a), of a concentrate of the first aspect.

In a fourth aspect, the present invention provides the use in a liquid fuel for a turbine engined aircraft of a concentrate of the first aspect, wherein said liquid fuel is immiscible with water, characterised in that said use is to scavenge free water which exists in or is introduced into the said liquid fuel or oil as a contaminant by forming a stable water-in-oil-emulsion or water-in-oil-microemulsion, thereby to render or retain the said liquid fuel or oil in a usable state.

In a fifth aspect, the present invention provides a method of scavenging free water which exists in or is introduced as a contaminant into a liquid fuel which is immiscible with water, thereby to render or retain the said liquid fuel in a usable state, which method comprises: adding to a substantially water-free liquid fuel or to a liquid fuel contaminated with free water a concentrate of the first aspect in order to form a stable water-in-oil-emulsion or water-in-oil-microemulsion.

In each aspect of the present invention, the amounts of components (A) to (D) preferably add up to 100%.

The term "free-water" refers to water present as a separate visible liquid phase in a two phase liquid fuel and water mixture. This may arise from entrained water or water that is dissolved in the liquid fuel phase. Dissolved water becomes free water with lower temperatures due to the reduction in solubility of the water in liquid fuel.

In the above aspects of invention, the free-water exists in or is introduced into the liquid fuel as a contaminant i.e. it is not water which has been deliberately added to the liquid fuel, such as water added to a liquid fuel in the preparation of a water-in-oil emulsion or microemulsion. The free-water exists or is introduced as a contaminant in the liquid fuel or water when e.g. water is added to the liquid fuel accidentally or inadvertently, or the water is ambient moisture such as from rain or condensation water derived from changes in humidity levels in the atmosphere whilst the liquid fuel is in a tank vented to atmospheric conditions or in a tank which is subjected to wide temperature changes such as that on an aircraft. In the above aspects of the present invention, the free-water is preferably free-water introduced into the liquid fuel as ambient moisture. Whilst in extreme conditions the amount of free-water which may be introduced as a contaminant could comprise 0.5% by weight or more of the combined weight of water and liquid fuel, it will be apparent to those skilled in the art that in practice the amount of free-water contaminant will typically comprise significantly less than 0.5 wt % of the combined weight of free-water and liquid fuel. For example, typically the amount of free-water contaminating the liquid fuel will be less than 0.2 wt % and more typically less than 0.1 wt %, such as 0.05 wt % or less, by weight of the combined weight of water and liquid fuel.

The term "scavenge" means to act as a scavenger and a "scavenger" is a substance added to a chemical reaction or mixture to counteract the effect of impurities, as defined in Collins English Dictionary, Fourth Edition 1998, Reprinted 1999 (twice), HarperCollins Publishers.

The terms "liquid fuel" is herein used as substantially equivalent generic terms for liquids such as jet fuels, aviation gasolines, military grade fuels, diesels; kerosenes; gasolines/petrols (leaded or unleaded); paraffinic, naphthenic, heavy fuel oils, biofuels, waste oils or such as esters, poly alpha olefins; etc, and mixtures thereof. The liquid fuels most suitable for practising the present invention are the hydrocarbon fuel oils, most suitably jet fuel, aviation gasoline, military grade fuels, biodiesel, bioethanol, diesel, kerosene and gasoline/petrol.

Preferably the liquid fuel is for a turbine engined aircraft i.e. a liquid turbine fuel. A liquid turbine fuel is a turbine fuel customary in civilian or military aviation. These include, for example, fuels of the designation Jet Fuel A, Jet Fuel A-1, Jet Fuel B, Jet Fuel JP-4, JP-5, JP-7, JP-8 and JP-8+100. Jet A and Jet A-1 are commercially available turbine fuel specifications based on kerosene. The accompanying standards are ASTM D 1655 and DEF STAN 91-91. Jet B is a more highly cut fuel based on naphtha and kerosene fractions. JP-4 is equivalent to Jet B. JP-5, JP-7, JP-8 and JP-8+100 are military turbine fuels, as used, for example, by the Marines and Air Force. Some of these standards relate to formulations which already comprise further additives such as corrosion inhibitors, other icing inhibitors, static dissipators, detergents, dispersants, antioxidants, metal deactivators, etc.

The term "liquid fuel which is immiscible with water" refers to a liquid fuel, such as a hydrocarbon fuel oil, that is not miscible with water at greater than about 0.1% water, preferably at greater than 0.05%, i.e. any admixture of liquid fuel and water above 0.05% separates out on standing in to two phases.

The term emulsifying agent, surfactant and microemulsion-forming surfactant as used herein refers to any suitable surfactant or mixture of surfactants which is capable upon simple admixture with a mixture comprising two visible immiscible phases of a liquid fuel and water of forming a water-in-oil microemulsion. Formation of the microemulsion is substantially spontaneous upon the addition at ambient temperature (e.g. 10-30° C.) of the surfactant(s) to a mixture comprising two visible immiscible phases of a liquid fuel and water. Persons skilled in the art will be familiar with such surfactants or surfactant mixtures, for example as disclosed in the microemulsion prior art references mentioned above. Suitable stable, clear, water-in-oil microemulsion-forming surfactants are amphoteric or comprise a mixture of surfactants including at least one amphoteric betaine. The most preferred surfactants are the emulsifying agents herein below described.

Though the physical nature of the clear aqueous compositions is not fully understood, it is believed that the clear aqueous compositions comprise an aqueous phase distributed within a non-aqueous phase, wherein that the aqueous phase is distributed in the non-aqueous phase in the form of droplets, possibly micelles, having a size no greater than about 0.1 μm.

By referring to the microemulsion of the present invention as being "stable", we mean that the water phase in the water-in-oil emulsion exists as dispersed droplets having an average particles size of no greater than 0.1 μm in the oil phase for at least 12 months when stored at a constant temperature of 25° C. without stirring. The microemulsion is of a continuous fuel phase in which water droplets, having an average droplet size of no greater than or <0.1 μm is dispersed. The resultant clear translucent microemulsion remains thermodynamically stable when used as a fuel for us in jet or diesel engines. The droplets in the water-in-oil emulsion of the present invention may be in the form of micelles.

It has been found, surprisingly, that when a liquid fuel containing the relevant surfactants is cooled down below freezing, very few if any visible ice particles are formed in the fuel and no gel is formed. As a means to try to explain this very surprising phenomenon, but without wishing to be limited to this explanation, it is believed that the presence of the surfactants/emulsifying agents in the liquid fuel prevents the water from freezing but if it does not prevent the water from freezing at low temperatures it restricts the sizes of any ice crystals and agglomerates which may form in the cooled fuel. Thus, even if ice crystals are formed in the fuel, the surfactants/emulsifying agents in the fuel prevent the crystals from significant agglomeration and so no ice slugs are formed. Further, it is observed that no apple jelly is formed.

DETAILED DESCRIPTION

Liquid fuel is a hydrocarbon feedstock and can consist of any of the following: jet fuels, aviation gasolines, military grade fuels, diesel; kerosene; gasoline/petrol (leaded or unleaded); paraffinic, naphthenic, heavy fuel oils, biofuels, waste oils or such as esters, poly alpha olefins; etc, and mixtures thereof.

The present invention may provide a water content fluid that due to the inherent stability prevents the formation of ice particles and apple jelly.

Prior to the present invention, materials such as diethylene glycol monomethyl ether (DiEGME) have been used to prevent ice formation in fuel in small and military aircraft (commercial airlines tend to use tank heaters). Due to their chemical properties they are more soluble in water than in fuel and take a great deal of mixing to get into the fuel. Careful monitoring during the mixing process must be adhered to at all times to ensure an initial homogenous fuel. However, no matter how carefully mixed the DiEGME, (the chemistry is such that it will preferentially reside in the water phase as temperature reduces) it can separate from the fuel at low temperatures and enter the water phase. The DiEGME will prevent some of this water from turning to ice. However, the DiEGME water mixture has an unusual characteristic in that it forms a gel like substance often referred to as "apple jelly" in the aviation industry. Federal Aviation authorities have attributed several aviation accidents to this material. The present invention overcomes this problem by, it is believed, preventing the formation of large ice crystals or ice crystal agglomerates. Indeed, it is believed that if ice crystals and agglomerates are formed in the fuel, the size of such particles is restricted to sub-micron particles (<1 μm). The microemulsion offers several advantages over the use of DiEGME. The latter tends to be more hygroscopic in nature and will draw water into a system. The DiEGME is also chemically aggressive and may attack fuel tank linings etc, and needs to be used at higher levels than the emulsifying agents. The handling and disposal of DiEGME is also costly due to the hazardous nature of the product. Other than in the operating examples, or where otherwise indicated, all numbers expressing quantities of ingredients used herein are to be understood as modified in all instances by the term "about".

The microemulsion of the present invention may be prepared from fuels that are standard grades available at any service station or from industrial suppliers. Preferably, the fuel oil is selected from jet fuels, aviation gasolines, military grade fuels, diesel, kerosene, gasoline/petrol (leaded or unleaded) and mixtures thereof. Preferably the liquid fuel is for a turbine engine aircraft i.e. a liquid turbine fuel. A liquid turbine fuel is a turbine fuel customary in civilian or military aviation. These include, for example, fuels of the designation Jet Fuel A, Jet Fuel A-1, Jet Fuel B, Jet Fuel JP-4, JP-5, JP-7, JP-8 and JP-8+100. Jet A and Jet A-1 are commercially available turbine fuel specifications based on kerosene. The accompanying standards are ASTM D 1655 and DEF STAN 91-91. Jet B is a more highly cut fuel based on naphtha and kerosene fractions. JP-4 is equivalent to Jet B. JP-5, JP-7, JP-8 and JP-8+100 are military turbine fuels, as used, for example, by the Marines and Air Force. Some of these standards relate to formulations which already comprise further additives such as corrosion inhibitors, icing inhibitors, static dissipators, detergents, dispersants, antioxidants, metal deactivators, etc. Typical classes and species of such further additives are disclosed in US 2008/0178523 A1, US 2008/0196300 A1, US 2009/0065744 A1, WO 2008/107371 and WO 2009/0010441.

The mixture ratios of the fuel and water employed in the present emulsion are dependent upon many factors. Generally speaking, the fuel comprises at least about 99%, preferably at least about 99.5%, more preferably at least about 99.995%, most preferably about 99.999% by weight, based on the total weight of the clear aqueous composition or emulsion. Generally speaking, the fuel phase comprises no greater than about 99.999% by weight, and preferably no more than about 99.99% by weight.

Typically, the composition or microemulsion comprises from about 0.0001 to about 1.0% by weight of surfactants/emulsifying agents, preferably from about 0.0001 to about 0.50%, more preferably from about 0.0001 to about 0.1%, and even more preferably from about 0.0001 to about 0.025%. The emulsifier is most preferably a mixture of emulsifying agents selected to minimise the total amount of emulsifier required to form a microemulsion for a given fluid.

Where a compound is referred to as being "ethoxylated", we mean it includes at least 2 EO groups. Preferably ethoxylated compounds comprise from 2 to 12 EO groups.

In a preferred embodiment, the one or more $C_6$-$C_{15}$ alkanol ethoxylates as component (B) have an average degree of methyl branching for the alkanol unit of 3.7 or less, preferably of 2.5 or less, typically of from 1.5 to 2.5, or, as an alternative, of 3.7 or less, preferably of 1.5 or less, typically of from 1.05 to 1.0.

The $C_6$-$C_{15}$ alcohol ethoxylates may have a degree of methyl branching of at least 2 on the alkanol unit.

When a mixture of $C_6$-$C_{15}$ alcohol ethoxylates is employed in the microemulsion, it is preferably a mixture of $C_9$-$C_{14}$ alcohol ethoxylates, such as a mixture of $C_9$ to $C_{11}$ alcohol ethoxylates or a mixture of $C_{12}$-$C_{14}$ alcohol ethoxylates. The distribution of any of the components in the mixture can range from 0 to 50% by weight, and are preferably distributed in a Gaussian format. Commercially available $C_6$-$C_{15}$ alcohol ethoxylates include relevant products sold by leading chemical companies. An example of a commercial $C_{12}$-$C_{14}$ alcohol ethoxylate is Lauropal 2 (available from Witco, England).

In one embodiment, a concentrate comprises:

(A) 0.1 to 10 wt. % of one or more amphoteric emulsifying agents;

(B) 30 to 95 wt. % of nonionic alkoxylated surfactants;

(C) 0 to 20 wt. % of one or more glycol-based solubilizers; and (D) 0 to 65 wt. % of one or more organic solvents, wherein component (B) comprises a mixture of $C_6$-$C_{15}$-alkanol ethoxylates with different carbon numbers for the alkanol unit species, the carbon numbers for the two $C_6$-$C_{15}$-alkanol ethoxylates which have the highest share in weight in the mixture being at least 1.5 carbon numbers distant from each other. Preferably, in the mixture of $C_6$-$C_{15}$-alkanol ethoxylates, the carbon number for one of the two $C_6$-$C_{15}$-alkanol ethoxylates which have the highest share in weight in the mixture are in the range of 9 to 11 for one and in the range of 12 to 14 for the other. Such mixture preferably comprises two single-carbon $C_6$-$C_{15}$-alkanol ethoxylates species in a weight ratio of from 10:90 to 90:10, more preferably of from 30:70 to 70:30, most preferably of about 50:50. A typical example of such single-carbon $C_6$-$C_{15}$-alkanol ethoxylates mixture is a mixture of isodecanol ethoxylate with 3 ethylene oxide units (commercially available from BASF SE under Lutensol® ON 30) and tridecanol ethoxylate with 5 ethylene oxide units (commercially available from BASF SE under Lutensol® TO 5) in the weight ratio of 50:50; each of these two alkanol ethoxylate components exhibits an average degree of methyl branching for the alkanol unit of 2.2.

In one embodiment of the present invention, the concentrate consists essentially of components (A) to (D).

The emulsifying agents employed in the present invention are liquids at room temperature.

The emulsifier composition may also include other materials such as aliphatic alcohols, glycols and other components which can be added to a fuel as standard additives.

In another embodiment, the emulsifying agent comprises the following: (i) 2 parts cocamidopropyl betaine; (ii) 60 parts $C_6$-$C_{11}$ alcohol ethoxylate; (iii) 4 parts ethylene glycol and (iv) 34 parts ethanol In one embodiment of the present invention, a microemulsion is prepared by mixing:

(a) about 99.995 to 99.999 parts, e.g. 99.998 parts, fuel, e.g. a jet fuel; and (b) about 0.0001 to about 0.01 parts, e.g. 0.025 parts, emulsifying agents, wherein the emulsifying agents include i) a fatty ($C_8$-$C_{24}$)-amido-($C_1$-$C_6$)alkyl betaine, ii) a $C_6$-$C_{15}$ alcohol ethoxylate comprising from 2 to 12 EO groups or a mixture of such alcohol ethoxylates, wherein all parts are by volume.

The present invention may be utilised in, among others, jet engines, diesel engines, oil burning heating systems and is suited to all uses within these application areas. Other uses within the fuels industry will be apparent to those skilled in the art.

The microemulsion may comprise additional components. These additional components may be incorporated to improve anti-wear, extreme pressure properties, improve cold weather performance or improve fuel combustion. The requirement to add additional components may be dictated by the application area in which the microemulsion is used. Suitable additional components, and the requirement thereof depending on application area, will be apparent to those skilled in the art.

The composition may be added at the wing of the aircraft to prevent unwanted water pick up during the process of transferring the fuel from refinery to fuel depot. The composition can be supplied and intimately mixed with the fuel using a standard fuel bowser that is currently in operation at any airport. The additive composition can be dosed at the required rate directly into the fuel as it is pumped into the aircraft wing using e.g. a venturi system. This allows intimate mixing to occur and due to the nature of the composition it readily distributes throughout the fuel and will remain distributed in the fuel even at temperatures down to as low as −50° C.

The present invention will now be further described by way of example.

EXAMPLES

Reference hereafter to "a water-in-oil microemulsion wherein the emulsion is a clear translucent emulsion" is believed to be analogous to "a water-in-oil microemulsion, wherein the average droplet size of the water phase of the water-in-oil emulsion is no greater than 0.25 μm, preferably no greater than 0.1 μm". In the present examples, the emulsions were visually inspected. Those which were clear were considered to have an average droplet size of the water phase of the water-in-oil emulsion of no greater than 0.1 μm.

In the following examples, all "parts" are parts by weight, unless stated otherwise.

Example 1

A concentrate suitable for combining jet fuel (kerosene) with water was prepared by adding the following components in the quantities stated:

(i) 97 parts of the Lutensol® ON 30/Lutensol® TO 5 mixture in the weight ratio of 50:50, as disclosed above, and (ii) 3 parts cocamidopropyl betaine.

The components were gently mixed to form a homogenous composition.

Example 2

A concentrate suitable for combining jet fuel with water was prepared by adding the following components in the quantities stated:

i) 1 part by wt cocamidopropyl betaine; (ii) 8 parts by wt of the Lutensol® ON 30/Lutensol® TO 5 mixture in the weight ratio of 50:50, as disclosed above; (iii) 3 parts by wt $C_{10}$ alkyl amine oxide and iv) 90 parts fatty ($C_6$-$C_{24}$) acid amine ethoxylates comprising from about 2 to 20 EO groups.

The components were gently mixed to form a homogenous composition.

Example 3

A concentrate suitable for combining jet fuel with water was prepared by adding the following components in the quantities stated:

(i) 5 parts by wt cocamidopropyl betaine; (ii) 75 parts by wt of the Lutensol® ON 30/Lutensol® TO 5 mixture in the weight ratio of 50:50, as disclosed above; (iii) 10 parts by wt $C_{10}$ alkyl amine oxide and iv) 10 parts fatty ($C_6$-$C_{24}$) acid amine ethoxylates comprising from about 2 to 20 EO groups.

The components were gently mixed to form a homogenous composition.

Example 4

A concentrate suitable for combining jet fuel with water was prepared by adding the following components in the quantities stated:

(i) 2 parts cocamidopropyl betaine; (ii) 60 parts of the Lutensol® ON 30/Lutensol® TO 5 mixture in the weight ratio of 50:50, as disclosed above; (iii) 4 parts ethylene glycol and (iv) 34 parts ethanol The components were gently mixed to form a homogenous composition.

Example 5

0.0011 of the concentrate from Example 1 was added to 1 l of jet fuel (kerosene) contaminated with 200 ppm of water. The composition was introduced to the oil and water from a micro pipette. The resulting fluid was gently mixed until a clear translucent fluid was observed. The resulting fluid remains stable after more than one year.

Example 6

0.001 l of the concentrate from Example 2 was added to 1 l of jet fuel contaminated with 200 ppm of water. The composition was introduced to the oil and water from a micro pipette. The resulting fluid was gently mixed until a clear translucent fluid was observed. The resulting fluid remains stable after more than one year.

Example 7

0.001 l of the concentrate from Example 3 was added to 1 l of jet fuel contaminated with 200 ppm of water. The composition was introduced to the oil and water from a micro pipette. The resulting fluid was gently mixed until a clear translucent fluid was observed. The resulting fluid remains stable after more than one year.

Example 8

0.001 l of the concentrate from Example 4 was added to 1 l of jet fuel contaminated with 200 ppm of water. The composition was introduced to the oil and water from a micro pipette. The resulting fluid was gently mixed until a clear translucent fluid was observed. The resulting fluid remains stable after more than one year.

Example 9

The concentrate from Example 4 was subject to differential scanning calorimetry (DSC) in comparison to current anti icing product diethylene glycol monomethyl ether (DiEGME) in jet fuel. The resulting scans showed that the composition performed equally as well as the DiEGME in the absence of water but in the presence of 200 ppm water contamination the composition showed no phase changes indicating no ice formation, whereas the DiEGME showed that ice was forming due to its poor solubility in fuel allowing free water particularly at lower temperatures i.e. −40° C.

Example 10

The concentrate from Example 4 was used to evaluate microbial growth in aviation fuel. A series of tests based upon the Speed of Kill and the Persistence of Kill were carried out in comparison to an untreated water contaminated aviation fuel. In all cases the composition prevented the growth of microbial content whereas, the untreated control showed growth up to $10^7$ colony forming units.

Various modifications and variations of the described methods and system of the invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention which are obvious to those skilled in chemistry or related fields are intended to be within the scope of the following claims.

What is claimed is:

1. A method of scavenging free water which exists in or is introduced as a contaminant into a liquid fuel or oil which is immiscible with water, thereby to render or retain the said liquid fuel or oil in a usable state, which method comprises: adding to a substantially water-free liquid fuel or oil or to a liquid fuel or oil contaminated with free water a liquid concentrate in order to form a stable water-in-oil-emulsion or water-in-oil-micro emulsion;

said liquid concentrate comprising:

(A) 0.5 to 5 wt. % of one or more fatty ($C_8$-$C_{24}$)-amido-($C_1$-$C_6$)-alkyl betaine emulsifying agents;

(B) 45 to 75 wt. % of $C_6$-$C_{15}$-alkanol ethoxylate surfactants;

(C) 0.5 to 10 wt. % of one or more glycol-based solubilizers; and (D) 5 to 50 wt. % of one or more organic solvents;

wherein: i) component (B) comprises a mixture of $C_6$-$C_{15}$-alkanol ethoxylates with different carbon numbers for the alkanol unit species and 2 to 5 moles of ethylene oxide units on average per mole of alkanol; ii), the carbon numbers for the two $C_6$-$C_{15}$-alkanol ethoxylates which have the highest share in weight in the mixture being at least 1.5 carbon numbers distant from each other; and iii) the carbon number for one of the two $C_6$-$C_{15}$-alkanol ethoxylates which have the highest share in weight in the mixture is in the range of 9 to 11 and the other is in the range of 12 to 14.

2. The method as claimed in claim 1, wherein the liquid fuel or oil is a jet fuel or kerosene.

3. The method as claimed in claim 1, wherein the liquid concentrate comprises cocoamidopropyl betaine as component (A).

4. The method as claimed in claim 1, wherein the liquid concentrate comprises as component (B) one or more $C_6$-$C_{15}$-alkanol ethoxylates with an average degree of methyl branching for the alkanol unit of 3.7 or less.

5. The method as claimed in claim 1, wherein the liquid concentrate comprises one or more $C_9$-$C_{14}$-alkanol ethoxylates as component (B).

6. The method as claimed in claim 1, wherein the liquid concentrate comprises ethylene glycol as component (C).

7. The method as claimed in claim 1, wherein the liquid concentrate comprises one or more $C_1$-$C_4$ alkanols as component (D).

8. The method as claimed in claim 7, wherein the liquid concentrate comprises ethanol as component (D).

9. The method as claimed in claim 1, wherein the liquid concentrate is prepared by mixing components (A) to (D) together at a temperature of from −10° C. to 60° C.

10. The method as claimed in claim 1, wherein the liquid concentrate is prepared by mixing components (A) to (D) together at a temperature of from 0° C. to 40° C.

* * * * *